United States Patent [19]

Suzuki et al.

[11] 4,384,174

[45] May 17, 1983

[54] MOVING VOICE COIL LOUDSPEAKER, PERIPHERAL DIAPHRAGM SUPPORT, DIAPHRAGM CONSTRUCTION, BOBBIN TO DIAPHRAGM REINFORCEMENT

[75] Inventors: Kiyoaki Suzuki; Masaru Watanabe; Hisashi Yamamoto; Tomoharu Hayashi; Takuji Miura, all of Yokohama, Japan

[73] Assignee: Victor Company of Japan, Limited, Yokohama, Japan

[21] Appl. No.: 193,004

[22] Filed: Oct. 2, 1980

[30] Foreign Application Priority Data

| | | | |
|---|---|---|---|
| Oct. 2, 1979 | [JP] | Japan | 54-136429[U] |
| Oct. 2, 1979 | [JP] | Japan | 54-136430[U] |
| Oct. 23, 1979 | [JP] | Japan | 54-145856[U] |

[51] Int. Cl.[3] ..... H04R 9/06; H04R 7/16; H04R 7/06

[52] U.S. Cl. ..... 179/115.5 R; 179/115.5 VC; 179/181 F; 181/170; 181/171; 181/174

[58] Field of Search ..... 179/115.5 R, 115.5 VC, 179/181 F, 115.5 ES; 181/167, 170, 171, 172, 173, 174

[56] References Cited

U.S. PATENT DOCUMENTS

| | | | |
|---|---|---|---|
| 1,852,068 | 4/1932 | Sykes | 181/172 |
| 2,014,621 | 9/1935 | Jensen | 179/115.5 R |
| 2,860,721 | 11/1958 | Hassan | 181/172 |
| 3,111,187 | 11/1963 | Barlow | 181/170 |
| 3,801,943 | 4/1974 | Bertagni | 179/115.5 R |
| 4,122,314 | 10/1978 | Matsuda et al. | 179/115.5 R |
| 4,163,876 | 8/1979 | Ohnuki | 179/181 F |
| 4,190,746 | 2/1980 | Harwood et al. | 179/115.5 R |
| 4,235,302 | 11/1980 | Tsukamoto | 181/172 |
| 4,239,090 | 12/1980 | Dahlquist | 179/182 |
| 4,259,550 | 3/1981 | Nakamatsu | 179/115.5 VC |
| 4,313,040 | 1/1982 | Tsukamoto | 179/115.5 R |

FOREIGN PATENT DOCUMENTS

| | | | |
|---|---|---|---|
| 892903 | 5/1944 | France | 179/115.5 R |
| 1453850 | 8/1966 | France | 179/115.5 R |
| 91732 | 6/1968 | France | 179/115.5 R |
| 52-42113 | 1/1977 | Japan | 181/171 |
| 52-68408 | 7/1977 | Japan | 179/115.5 ES |
| 55-53996 | 4/1980 | Japan | 181/172 |
| 55-95499 | 7/1980 | Japan | 179/115.5 VC |
| 321430 | 11/1929 | United Kingdom | 179/115.5 R |
| 533913 | 2/1941 | United Kingdom | 179/115.5 R |
| 1003608 | 9/1965 | United Kingdom | 181/167 |
| 1270033 | 4/1972 | United Kingdom | 181/167 |
| 1493296 | 11/1977 | United Kingdom | 179/115.5 ES |
| 2037123 | 7/1980 | United Kingdom | 179/115.5 VC |

*Primary Examiner*—George G. Stellar
*Attorney, Agent, or Firm*—Lowe, King, Price & Becker

[57] ABSTRACT

The diaphragm of a speaker is supported by a viscous supporting member placed in an annular gap defined between the periphery of the diaphragm and the inner surface of a frame structure and by a conventional damper. Grooves may be made in the periphery of the diaphragm and in the inner surface of the frame structure for receiving some portions of the viscous supporting member. In another embodiment, a film made of a resin is welded to the front surface of a diaphragm body which is made of a foam resin. In other embodiments, one or more reinforcing members are fixedly adhered to both the voice coil bobbin and the flat rear surface of the diaphragm.

22 Claims, 10 Drawing Figures

MOVING VOICE COIL LOUDSPEAKER, PERIPHERAL DIAPHRAGM SUPPORT, DIAPHRAGM CONSTRUCTION, BOBBIN TO DIAPHRAGM REINFORCEMENT

FIELD OF THE INVENTION

This invention generally relates to a speaker, and particularly the present invention relates to a hi-fi speaker having a diaphragm the sound radiating surface of which is substantially flat.

BACKGROUND OF THE INVENTION

In a conventional edgeless speaker, a diaphragm having a flat sound radiating surface is supported by means of a damper which is fixedly connected at its other end to the frame or housing of the speaker. Since the diaphragm is supported in the direction of its essentially reciprocal movement at one location, it is apt to perform a pendulum movement centering around the supporting portion when the voice coil is energized. As the diaphragm performs such a pendulum movement, a voice coil bobbin fixedly connected to the rear surface of the diaphragm undesirably comes into contact with the magnetic circuit, resulting in the occurrence of abnormal sounds. In other words, because of the pendulum movement the direction of the movement of the diaphragm and the voice coil bobbin is not always parallel to the walls of the magnetic gap in which the voice coil bobbin is supposed to move reciprocally. In order to improve the sound quality the diaphragm is required to move only in one direction, parallel to the axis of the voice coil bobbin.

In addition, it is necessary to prevent the air behind the diaphragm from leaking outwardly toward the front side thereof to improve the sound pressure level to frequency characteristic. With the above-mentioned conventional edgeless speaker, however, the air behind the diaphragm is easily radiated toward the front side through an annular gap defined between the periphery of the diaphragm and the inner surface of the frame or housing. As a result, a dip occurs in the sound pressure level to frequency characteristic curve in the low frequency range.

Generally speaking, such a speaker diaphragm having a flat sound radiating surface is required to be light in weight, and not to change with time. In addition, it is desirable that the sound radiating surface portion of the diaphragm have a given stiffness for improvement in the sound quality. Therefore, in order to reduce weight, some conventional speakers have diaphragms made of a foam resin, such as a foam polyurethane resin, a foam acrylic resin, a form styrene resin, or the like. In order to manufacture such a diaphragm with the above-mentioned resin, a molding technique, is typically used in which a raw material of a foam resin, which is in the form of beads, is put in a mold, and the mold is heated up to a given temperature to effect foaming. However, when a diaphragm is simply made by means of a mold, such a diaphragm has high-density layers close to the surfaces thereof. Because of the high-density surface layers the total weight of the diaphragm is heavier than a diaphragm having a small and constant density throughout the entire portions thereof. Such a diaphragm having a constant density of a foam resin throughout the entire portions thereof can be manufactured by shaving the surfaces of the diaphragm made by means of a mold to remove the high-density surface layers. Of course it is also possible to form such a diaphragm by cutting a foam resin block or plate to the shape of a desired diaphragm.

However, the diaphragm made by one of the above-mentioned techniques has the following disadvantages: Namely, there are blowholes made on foaming at the exposed surfaces. Therefore, the sound radiating surface, which will be exposed to the outside of a speaker enclosure, is easily damaged. Furthermore, because of the presence of the blowholes the sound radiating surface is not smooth, resulting in poor sound reproducing characteristics. Such undulatory surfaces of the diaphragm have a poor lightproof characteristic and a poor moistureproof characteristic so that the color of the sound radiating surface changes within one or two years, and the elasticity at the same surface reduces as time goes because of air-slaking. Once the sound radiating surface of the diaphragm has deteriorated in this manner, rags come off from the surface to scatter due to vibrations of the diaphragm. Therefore, it is necessary to protect the sound radiating or front surface by attaching a thin sheet or film to the front surface which is exposed to the front portion of the speaker enclosure.

Since the stiffness at the surfaces having blowholes is relatively small, if the sound radiating surface is simply constructed of such a surface, the sound pressure level at a given frequency is abnormally low resulting in a poor frequency characteristic of a speaker.

Although it is known that a sheet of paper is adhered to the front portion of a diaphragm to protect the front surface of the diaphragm made of a foam resin and to increase the stiffness at the sound radiating surface portion, such a sheet of paper is easily detached due to vibrations and is further prone to deterioration with the passage of time.

Therefore, it is desirable to use a sheet of film made of a resin. There are two possible structures of a diaphragm having such a film of resin adhered to the flat front surface thereof, as follows: The first structure is one wherein the film is adhered to the flat front surface after directly spreading an adhesive agent on the front surface of the diaphragm. With this structure, however, the adhesive agent is unnecessarily absorbed by recesses or blowholes at the front surface of the diaphragm so that the diaphragm becomes too heavy. The other structure is one wherein the adhesive agent is spread on a surface of the film to be attached to the front surface of the diaphragm before the film is adhered to the front surface. With this structure, however, if the amount of the adhesive agent is too small, the film would be adhered to only the projecting portions in the flat front surface of the diaphragm resulting in a weak adhesive force therebetween. As a result, the film easily comes off due to vibrations. On the contrary, if the amount of the adhesive agent is too large, although the adhesive force is strong, the weight of the diaphragm would increase as much as the increase in the amount of the adhesive agent.

Apart from the above-mentioned various disadvantages, up to this time, for instance, in a cone type speaker, undulations occur in the sound pressure level to frequency characteristic curve due to the diaphragm shape, although the diaphragm vibrates reciprocally. For instance, in a speaker having vertex angle of 120 degrees and diameter of 8 inches, there is a peak of approximately 5 dB around 1 KHz, and a dip of approximately 10 dB around 6 KHz. The degrees of the peak and dip reduces as the vertex angle becomes large, and therefore, it is necessary to make the sound radiating surface flat in order to remove the influence of the shape. However, the resonance frequency of a speaker diaphragm which is flat and has a constant thickness is low compared to a cone type diaphragm. Therefore, when a flat speaker diaphragm is used, it is required to make the thickness great and also make the flexural rigidity great. In addition, it is desirable to manufacture a speaker diaphragm of a low density material because the weight of the speaker diaphragm tends to increase as the thickness increases. As such a material, a foam resin, such as a foam acrylic resin, Reticulated Vitreous Carbon (trademark of Fluoro Carbon Co.) or the like may be used. Also such a light diaphragm may be manufactured by sandwiching a disk having a honeycomb mesh structure by a pair of thin sheets of a light metal, such as aluminum. Up to this time, in order to connect the voice coil bobbin to the speaker diaphragm, an annular recess is made in the rear surface portion of the diaphragm made of a foam resin for receiving one end of the voice coil bobbin. In other words, the edge portion of the voice coil bobbin is inserted in the annular recess made in the back of the diaphragm. However, it is very difficult to make such a recess in such a manner that the center axis of the diaphragm agrees with the center axis of the voice coil bobbin. Furthermore, in case of a diaphragm having the above-mentioned honeycomb mesh structure, it is impossible to make such a recess. Therefore, in a conventional speaker having such diaphragm of honeycomb mesh structure, the voice coil bobbin is simply adhered at its one end to the rear side of the diaphragm. In such a speaker, the efficiency in vibration transmission from the voice coil bobbin to the diaphragm is poor.

SUMMARY OF THE INVENTION

The present invention has been developed in order to remove the above-mentioned disadvantages and drawbacks inherent to the conventional speakers.

It is, therefore, a primary object of the present invention to provide a speaker in which the diaphragm does not perform a pendulum movement.

Another object of the present invention is to provide such a speaker in which the air behind the diaphragm is prevented from leaking through the gap between the periphery of the diaphragm and the housing of the speaker.

A further object of the present invention is to provide a speaker and/or a diaphragm therefor in which the sound radiating surface of the diaphragm made of a foam resin is protected, while the lightproof and moistureproof characteristics thereof are improved.

A further object of the present invention is to provide a speaker and/or a diaphragm therefor in which stiffness at the sound radiating surface is improved to provide high-quality sounds.

A further object of the present invention is to provide a speaker in which the voice coil bobbin is readily connected to the diaphragm.

Still a further object of the present invention is to provide a speaker in which the voice coil bobbin can be fixedly attached to the diaphragm.

Yet a further object of the present invention is to provide a speaker in which the efficiency in vibration transmission from the voice coil bobbin to the diaphragm is improved.

In accordance with the present invention there is provided a speaker comprising: (a) a frame structure having a recess on the inner surface thereof; (b) a magnetic circuit means for constituting a magnetic gap, the magnetic circuit means being fixedly connected to the frame structure; (c) a voice coil bobbin around which a voice coil is wound, the voice coil bobbin being reciprocally movable in the magnetic gap; (d) a damper connected between the voice coil bobbin and the frame structure; (e) a diaphragm fixedly connected at one side thereof to one end of the voice coil bobbin, the diaphragm being received in the frame structure without coming into contact with the frame structure and having a recess on a peripheral surface thereof; and (f) a diaphragm supporting member made of a viscous material, the diaphragm supporting member being placed between the peripheral surface of the diaphragm and the inner surface of the frame structure in such a manner that some portions of the supporting member fill in the recesses of the frame structure and diaphragm.

In accordance with the present invention there is also provided a speaker diaphragm comprising: (a) a body made of a foam resin; and (b) a sound radiating surface portion connected to the body, the sound radiating surface portion having a film made of a resin, and a heat-fusible adhesive agent placed on one side of the film, the heat-fusible adhesive agent being welded to the body.

In accordance with the present invention there is also provided a speaker having a flat disk-like diaphragm connected to a voice coil bobbin for receiving a vibration force, wherein the improvement comprises: a reinforcing means fixedly connected to the voice coil bobbin and to the diaphragm.

BRIEF DESCRIPTION OF THE PREFERRED EMBODIMENTS

These and other objects and features of the present invention will be readily apparent from the following detailed description of the preferred embodiments taken in conjunction with the accompanying drawings in which.

DETAILED DESCRIPTION OF THE PREFERRED EMBODIMENTS

Prior to describing the embodiments of the invention, a conventional edgeless speaker will be discussed for a better understanding of the objects of the first and second embodiments of the present invention.

Figure 1:
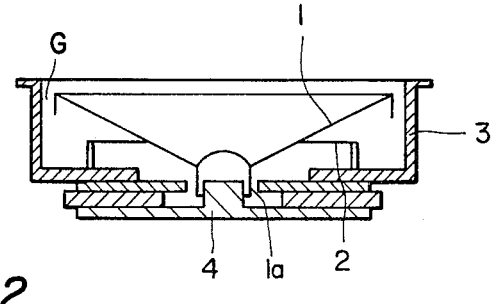
FIG. 1 is a schematic cross-sectional view of a conventional edgeless speaker.

FIG. 1 illustrates a cross-sectional view of a conventional edgeless speaker. A diaphragm 1 is supported at a portion near the center of the side surface thereof by a damper 2 to be disposed in a frame or housing 3. Since the diaphragm 1 is supported only by the damper 2, the diaphragm is apt to perform a pendulum movement centering around the supporting portion. As diaphragm 1 performs such a pendulum movement, a voice coil bobbin 1*a*, which is fixedly connected to the rear end portion of the diaphragm 1, undesirably comes into contact with a magnetic circuit 4 constituting a magnetic gap (no reference numeral) in which the voice coil bobbin 1*a* is reciprocally movable, resulting in the occurrence of abnormal sounds. Furthermore, because of the presence of a gap G between the periphery of diaphragm 1 and the inner surface of housing 3, the vibrating air behind the diaphragm 1 is radiated through the gap G to the front portion so that a dip occurs in the sound pressure level curve in the low frequency range.

The first and second embodiments of the present invention aim to remove the above-mentioned drawbacks, and these embodiments will be described with reference to the drawings.

Figure 2:
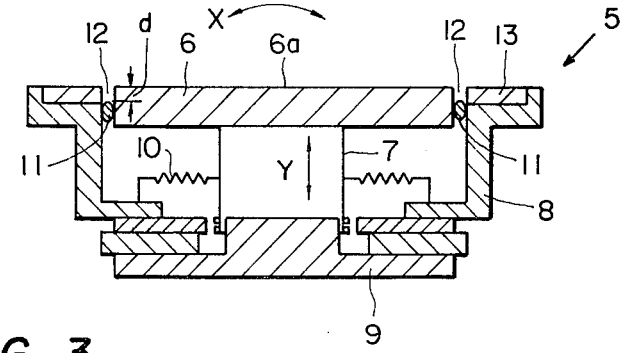
FIG. 2 is a schematic cross-sectional view of a first embodiment of the speaker according to the present invention.

FIG. 2 illustrates a schematic cross-sectional view of a high-frequency range edgeless speaker 5 (tweeter) which is a first embodiment of the speaker according to the present invention. In the edgeless speaker 5 shown in FIG. 2, a reference numeral 6 designates a flat disk-like diaphragm made of a foam acrylic resin, where the diaphragm has a given thickness and its sound radiating surface 6*a* is made flat. A voice coil bobbin 7 is fixedly adhered to the rear side of the flat diaphragm 6.

A reference numeral 8 designates a speaker frame or housing enclosing the flat diaphragm 6, and on the rear portion thereof is disposed a magnetic circuit 9 having a magnetic gap in which the voice coil bobbin 7 is reciprocally movable.

The combination of the flat diaphragm 6 and the voice coil bobbin 7 may be referred to as a vibrating system, and is supported by two members. Namely, the first member is a damper 10 which is connected between an outer surface of the voice coil bobbin 7 and the housing 8. Damper 10 has structure substantially the same as in the conventional speakers. The second member is a viscous supporting member 11 interposed between the periphery of the diaphragm 6 and the inner surface of the housing 8. In detail, the diameter of the diaphragm 6 is made a little smaller than the inside diameter of the housing 8 in order to have an annular gap 12 therebetween, and the above-mentioned viscous supporting member 11 is placed in the gap 12. The viscous supporting member 11 may be placed in the annular gap 12 by painting a grease-like material, such as No. 464 of Moyen Co., by means of a fine brush on the peripheral surface of the flat diaphragm 6 and on a corresponding area in the inner surface of the housing 8. The grease-like material 11 is placed in the gap 12 in such a manner that it bridges the annular gap 12 along the entire circumference of the diaphragm 6. The viscous supporting member 11 is disposed at a position which is spaced by a distance "d" in the direction inwardly from the sound radiating surface 6*a*, and therefore, it does not project to the front of the diaphragm. The viscous material used in this embodiment is mainly made of vinyl chloride and has a viscosity of 12 poise.

With this arrangement, the vibrating system including the flat diaphragm 6 and the bobbin 7 are supported at two positions along the direction indicated by the arrow Y so that a pendulum movement indicated by an arrow X is securely restricted while movement in the direction of arrow Y is free. As a result, when the speaker emits sounds, friction between the voice coil bobbin 7 and the magnetic circuit 9 is securely prevented, and therefore, abnormal sounds caused by the friction do not occur.

In addition, because of the presence of the viscous supporting member 11, the air behind the diaphragm 6 does not leak toward the sound radiating surface 6*a* side. As a result, a sound pressure level characteristic having no dip in the low frequency range, can be obtained.

Furthermore, since the above-mentioned supporting member 11 has viscosity, it also functions as a damper. Because of this physical characteristic, the sound pressure level to frequency characteristic curve resulting from the resonance of the diaphragm 6 is smoother than that in conventional speakers.

Illustratively, let it be assumed that it is desired to obtain 100 dB in sound pressure level at a point spaced by 1 meter from the above-mentioned speaker, i.e. a tweeter, having the diaphragm 6 the radius of which is 2 centimeters. In this case, the effective amplitude of the diaphragm 6 at 3 KHz is approximately 0.08 millimeters, and it has been confirmed that the viscous supporting member 11 does not scatter due to the movement of the diaphragm 6.

A reference numeral 13 designates an annular supplementary plate made of Bakelite (trademark). The supplementary plate is disposed on a flange portion of the speaker housing 8. The combination of the housing 8 and the supplementary plate 13 may be referred to as a frame structure (no reference numeral). Supplementary plate 13 is used so that both the front surface of the frame structure and the sound radiating surface 6*a* of the diaphragm 6 lie in the same plane. In this manner, as the front surface of the housing 8 and the sound radiating surface 6*a* of the diaphragm 6 are in the same plane, the sound field close to the diaphragm 6 is such that the equiphase wave surface and the equiamplitude wave surface are respectively smooth.

Figure 3:
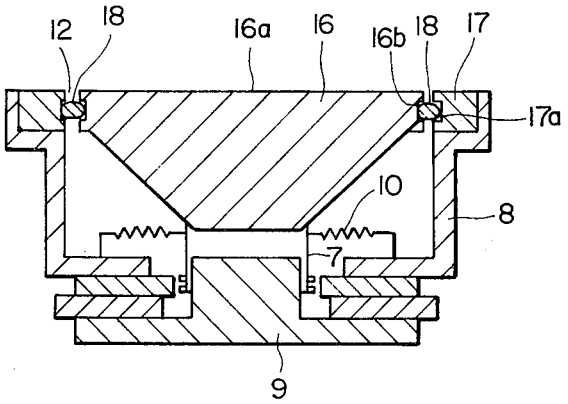
FIG. 3 is a schematic cross-sectional view of a second embodiment of the speaker according to the present invention.

FIG. 3 shows a schematic cross-sectional view of a low frequency range edgeless speaker (woofer), which is the second embodiment of the speaker according to the present invention. In FIG. 3, substantially the same elements as those in FIG. 2 are denoted by the same reference numerals, and the description thereof is omitted.

The edgeless speaker of FIG. 3 comprises a flat diaphragm 16 of truncated conical shape, where a first groove 16*b* is provided along the peripheral surface thereof in the vicinity of the sound radiating surface 16*a*.

A second groove 17*a* is made in the inner surface of the annular supplementary plate 17 fixed to the flange portion of the speaker housing 8. The combination of the housing 8 and the supplementary plate 17 may be referred to as a frame structure (no numeral). The first groove 16*b* and the second groove 17*a* are positioned at the both sides of the gap 12 to face on each other.

A viscous supporting member 18, which corresponds to the member 11 of FIG. 2 bridges the annular gap 12 defined between the peripheral surface of the diaphragm 16 and the inner surface of the supplementary plate 17 to close the gap 12 along the entire circumference of the diaphragm 16, where some portions of the viscous first and second grooves 16*b* and 17*a* are filled by the supporting member 18. The function of the viscous supporting member 18 is the same as in the above-mentioned embodiment. In addition, since some portions of the viscous supporting member 18 are inserted in the grooves 17*a* and 16*b*, the viscous supporting member 18 does remain at the above-mentioned position without scattering even though the diaphragm 16 may undergo a violent vibrating motion. Accordingly, this structure has significant effects especially when adapted to a woofer.

The above-mentioned first and second embodiments are just examples, and therefore, it will be understood that the viscous supporting member 11 or 18 may be added to any edgeless speakers as long as the diaphragm is enclosed by the speaker housing in such a manner that there is an annular gap therebetween, and the same result will be obtained.

As described above, in the first and second embodiments of the present invention, since the viscous supporting member 11 or 18 is disposed in the annular gap 12 between the diaphragm 6 or 16 and the frame structure which encloses the diaphragm 6 or 16, it is possible to support the diaphragm 6 or 16 stably; it is possible securely to prevent the occurrence of abnormal sounds due to the abnormal contact; the leakage of the air behind the diaphragm 6 or 16 toward the sound radiating surface side is eliminated; it is possible to remove the dip in the sound pressure level curve in the low frequency range; and furthermore, it is possible to obtain a flat sound pressure level to frequency characteristic curve since the supporting member 11 or 18 functions as an additional damper because of its physical characteristic of viscosity. In addition, by arranging the viscous supporting member 11 or 18 to be partially filled in the peripheral surface groove 16*b* of the diaphragm 16 and in the inner surface groove 17*a* of the frame structure as shown in FIG. 3, the viscous supporting member 18 is prevented from scattering even though the diaphragm 16 vibrates violently so that the second embodiment of FIG. 3 is especially suitable for woofers.

Figure 4:
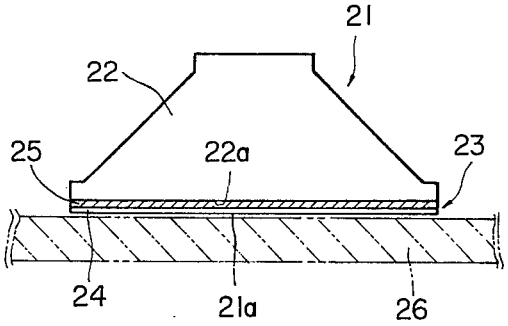
FIG. 4 is a schematic cross-sectional view of an embodiment of a diaphragm according to the present invention.

Reference is now made to FIG. 4 which shows a schematic cross-sectional view of a diaphragm according to the present invention. This diaphragm is for a woofer, and therefore, it can be adapted to the second embodiment speaker of FIG. 3. The diaphragm of FIG. 4 comprises a body 22 made of a foam resin, such as an acrylic resin, and a coated film 23. The coated film 23 comprises a sheet or film 24 coated with a heat-fusible or hot melt adhesive agent 25 at one side thereof. The coated film 23 is attached to the front surface 22*a* of the body 22, which front surface 22*a* functions as a sound radiating surface.

The diaphragm body 22 is manufactured by cutting a foam acrylic resin block or plate in such a manner that the shape thereof becomes a substantially truncated conical shapel. In this embodiment, all of the surfaces of the body 22 are cut surfaces. The film 24 is made of a resin where the above-mentioned heat-fusible adhesive agent 25 is deposited thinly on one surface of the film 24. In this embodiment, a product of Top Flite Models, Inc. is used as the coated film 23, which is 0.15 millimeter thick. The resin used for the film 24 is a heat resistive material, such as a polyester resin, so that it does not melt when heat is applied thereto as will be described hereinbelow. The adhesive agent 25 is sticky so that the film 24 can be temporarily attached to the front surface 22*a*.

After the coated film 23 is provisionally adhered to the front surface 22*a* of the diaphragm 22, the flat diaphragm for a woofer is placed on a heated iron plate 26 in such a manner that the film 24 comes into contact with the iron plate 26, which is heated up to 130 to 160 degrees centigrade. With this process, the adhesive agent 25 and the front surface 22*a* of the diaphragm body 22 melt so that these two members are welded to each other. Subsequently by removing the heated iron plate 26 and by cooling, the diaphragm body 22 and the film 24 made of a resin are fixedly adhered to each other.

Figure 5:
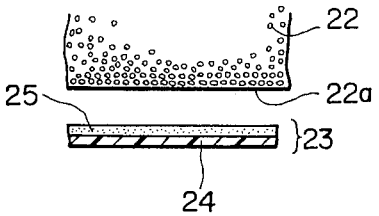
FIG. 5 and FIG. 6 are enlarged views of the diaphragm shown in FIG. 4 for showing the manufacturing process thereof.
Figure 6:
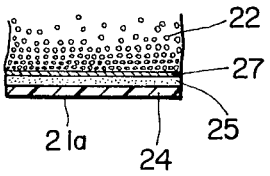

The junction between the diaphragm body 22 and the film 24 made of a resin is shown by an enlarged view in FIG. 5. In FIG. 6, a reference numeral 27 indicates a welded and frozen layer. This layer is obtained in such a manner that the front surface 22*a* of the diaphragm body 22 is melted uniformly to a short depth in the above-mentioned heating process to be welded to the melted adhesive agent 25, and is frozen inO the cooling process where bubbles have been disappeared.

As a result, the structure of the flat diaphragm 21 is such that the flat cut surface 22*a* of the diaphragm body 22 is covered by the film 24 in order to be protected. Although there results a slight increase in weight, the resulting structure has an adequate lightproof characteristic and a moisture-proof characteristic. Furthermore, the stiffness at the sound radiating surface 21*a* of the flat diaphragm 21 is improved because of the presence of the film 24 and also because of the presence of the welded-frozen layer 27.

Figure 7:
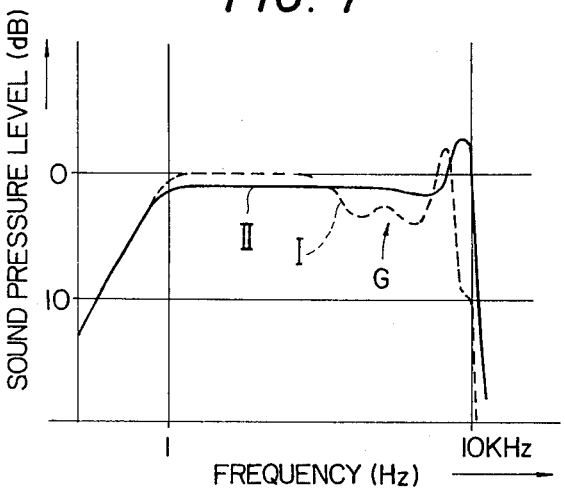
FIG. 7 is a graph showing the sound pressure level to frequency characteristic of a speaker including the diaphragm of FIG. 4 in contrast with a characteristic of a speaker having a conventional diaphragm.

As a result, the sound pressure level to frequency characteristic of a speaker having the above-mentioned flat diaphragm 21 becomes such as shown by a curve II in FIG. 7. Namely, although the radiating sound pressure level has been slightly fallen due to the increase in weight, so called middle-fall, which is indicated by a reference G, has been improved because of the increase in stiffness at the sound radiating surface 21*a*, and the audibility becomes superior.

As described in the above, in a speaker diaphragm according to the present invention, since the film 24 made of a resin with heat-fusible adhesive agent 25 is fixedly adhered by welding to the front surface 22*a* of the diaphragm body 22, which is made of a foam material, the speaker diaphragm 21 has various advantages, such as protection of the front surface 22*a* to improve the lightproof characteristic and the moistureproof characteristic thereof, while the increase in weight has been suppressed to a small value, the sound quality has been improved because of the increase in stiffness at the sound radiating surface portion, and the like.

Figure 8:
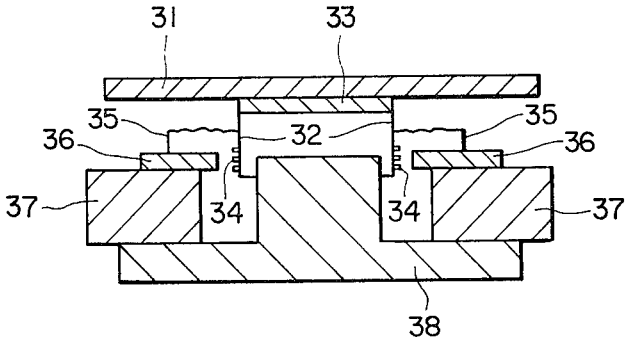
FIG. 8 is a schematic cross-sectional view of a third embodiment of the speaker according to the present invention.

Reference is now made to FIG. 8 which shows a schematic cross-sectional view of the third embodiment of the speaker according to the present invention. In FIG. 8, a reference numeral 31 designates a speaker diaphragm which has been cut to a given shape, for instance by die-cutting a flat plate, made of a foam resin, such as a foam acrylic resin, a foam styrene resin or the like, or a plate made of the above-mentioned Reticulated Vitreous Carbon (trademark). If desired, however, a pair of sheets or films made of a solid resin or a light metal may be fixedly attached to the both sides of the cut material. A similar flat disk-like diaphragm may also be manufactured by sandwiching a disk having a honeycomb mesh structure by a pair of sheets or films made of a light metal, such as aluminum. A reference numeral 32 designates a voice coil bobbin whose one end is adhered to the flat rear surface of the speaker diaphragm 31. A reference numeral 33 is a disk-like reinforcing member for adhering the voice coil bobbin 32, and this reinforcing member 33 is adhered by means of a suitable adhesive agent to both the speaker diaphragm 31 and the voice coil bobbin 32. It is preferable that the reinforcing member 33 for adhereing the voice coil bobbin 32 is made of a light material, such as a foam resin. If the shape is made annular rather than a disk-like shape as shown in FIG. 8, by removing the center portion, for example, after "8"; the radiating sound pressure level is increased because of the reduced weight.

In FIG. 8, a reference numeral 34 designates a voice coil; 35 a damper; 36 a top plate; 37 a magnet; and 38 a yoke. The top plate 36, the magnet 37 and the yoke 38 constitute a magnetic circuit (no reference numeral) having an annular magnetic gap in which the voice coil bobbin 32 is reciprocally movable. The magnetic circuit is fixedly supported by a housing which is not shown.

Figure 9:
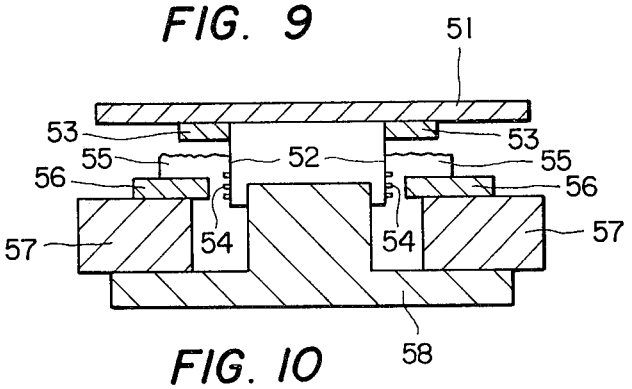
FIG. 9 is a schematic cross-sectional view of a fourth embodiment of the speaker according to the present invention.

FIG. 9 is a schematic cross-sectional view of the fourth embodiment of the speaker according to the present invention. In this embodiment, an annular reinforcing member 53 for adhering the voice coil bobbin 52 is disposed outside the voice coil bobbin 52 in contrast with the arrangement of the embodiment of FIG. 8 in which the reinforcing member 33 is disposed inside the voice coil bobbin 32. Namely, one end of the voice coil bobbin 52 is adhered to the flat rear surface of the speaker diaphragm 51 which is made in the same manner as in the first embodiment, while the annular reinforcing member 53 having an inside diameter equal to the outside diameter of the voice coil bobbin 52 is adhered to both the voice coil bobbin 52 and to the speaker diaphragm 51.

In FIG. 9, a reference numeral 54 designates a voice coil, 55 a damper; 56 a top plate; 57 a magnet; and 58 a yoke.

Figure 10:
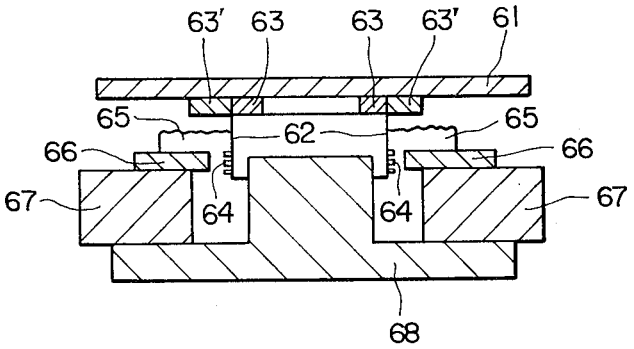
FIG. 10 is a schematic cross-sectional view of a fifth embodiment of the speaker according to the present invention.

FIG. 10 is a schematic cross-sectional view of the fifth embodiment of the speaker according to the present invention. This embodiment is similar to a combination of the third and fourth embodiments, and is such that one end of the voice coil bobbin 62 is adhered to the flat rear surface of the speaker diaphragm 61, which is made in the same manner as in the first embodiment, and reinforcing members 63 and 63' for adhering the voice coil bobbin 62 are adhered to the speaker diaphragm 61 and to the voice coil bobbin 62 at both the outside and the inside of the voice coil bobbin 62.

In FIG. 10, a reference numeral 64 designates a voice coil; 65 a damper; 66 a top plate; 67 a magnet; and 68 a yoke.

In the speaker constructed in the above-mentioned manner, the voice coil bobbin and the speaker diaphragm are strongly connected, the apparent connecting area between the voice bobbin and the speaker diaphragm is widened, and the driving energy is efficiently transmitted from the voice coil bobbin to the speaker diaphragm. Furthermore, the apparent stiffness at the junction area between the voice coil bobbin and the speaker diaphragm O- is increased so that the highest reproduction frequency becomes higher. The volume occupied by the reinforcing member for adhering the voice coil bobbin is small so that the weight is light resulting in a higher radiating sound pressure of the speaker. As described at the beginning of this specification, according to the prior art high manufacturing precision is required for making a recess in a resin diaphragm, which recess receives one end of the voice coil bobbin. The high precision is required to prevent the center axis of the voice coil bobbin from deviating from the center axis of the diaphragm, which deviation might cause a poor sound quality, such as abnormal vibrations due to eccentricity. On the other hand, in accordance with the present invention, there is no need to make such a recess in the speaker diaphragm, and therefore, speakers can be manufactured easily. Namely, since all that is required to adhere the voice coil bobbin and the reinforcing member to the rear surface of the speaker diaphragm, the center axes of the voice coil bobbin and the speaker diaphragm can be readily aligned with each other, so that superior sound quality can be obtained where no abnormal vibrations would occur.

Although the speaker diaphragm may be manufactured by means of a mold, it is preferably that the diaphragm is manufactured by die-cutting a flat plate made of a foam resin by means of a heated die-cutting device to a given shape, so that a speaker diaphragm can be simply manufactured at a low cost without getting out of shape.

As described in the above, in the speaker according to the third to fifth embodiments of the present invention, since the reinforcing member of members is/are adhered to both the speaker diaphragm and the voice coil bobbin, the speaker diaphragm and the voice coil bobbin are strongly connected to each other; the driving energy from the voice coil bobbin is efficiently transmitted to the speaker diaphragm; the highest reproducible frequency is high, and furthermore; the weight is light; the radiating sound pressure is great, and superior sound quality can be obtained where no adnormal vibrations occur. Moreover, since there is no need to make a recess in the speaker diaphragm for installing the voice coil bobbin, the speaker can be readily manufactured. Additionally, the present invention advantageously permits the voice coil bobbin to be simply installed in such a manner that the axes of the speaker diaphragm and of the voice coil bobbin align with each other.

What is claimed is:

1. A speaker comprising:

(a) a frame structure having a recess on an inner surface thereof;

(b) a magnetic circuit means for constituting a magnetic gap, said magnetic circuit means being fixedly connected to said frame structure;

(c) a voice coil bobbin around which a voice coil is wound, said voice coil bobbin being reciprocally movable in said magnetic gap;

(d) a damper connected between said voice coil bobbin and said frame structure;

(e) a diaphragm fixedly connected at one side thereof to one end of said voice coil bobbin, said diaphragm being received in said frame structure without coming into contact with said frame structure and having a recess on a peripheral surface thereof; and (f) a diaphragm supporting member made of a viscous material, said diaphragm supporting member being placed between the peripheral surface of said diaphragm and the inner surface of said frame structure in such a manner that some portions of said diaphragm supporting member fill in said recesses of said frame structure and said diaphragm.

2. A speaker as claimed in claim 1, wherein said diaphragm supporting member is placed along the entire circumference of said diaphragm.

3. A speaker as claimed in claim 1, wherein said peripheral surface of said diaphragm has a recess, and wherein a portion of said diaphragm supporting member is filled in said recess.

4. A speaker as claimed in claim 1, wherein said inner surface of said frame structure has a recess, and wherein a portion of said diaphragm supporting member is filled in said recess.

5. A speaker as claimed in claim 1, wherein said frame structure comprises a housing and an annular plate attached thereto forming at least a part of said inner surface of said frame structure, and wherein said recess on the inner surface of said frame structure is formed on said annular plate.

6. A speaker as claimed in claim 1, wherein said diaphragm is made of a foam resin.

7. A speaker as claimed in claim 1, wherein said diaphragm is a flat disk of constant thickness.

8. A speaker as claimed in claim 1, wherein said diaphragm is shaped substantially as a truncated cone.

9. A speaker as claimed in claim 1, wherein said diaphragm supporting member is spaced by a given distance from the sound radiating surface of said diaphragm.

10. A speaker as claimed in claim 1, wherein said frame structure comprises a housing fixedly connected to said magnetic circuit and to said damper, said housing having a flange portion, and further comprising a supplementary annular plate fixedly connected to said housing at the flange portion thereof.

11. A speaker as claimed in claim 10, wherein said supplementary annular plate is arranged in such a manner that both the front surface of said frame structure and the sound radiating surface of said diaphragm lie in the same plane.

12. A speaker as claimed in claim 10, wherein a groove is made in the inner surface of said supplementary annular plate for receiving a portion of said diaphragm supporting member.

13. A speaker as claimed in claim 1, wherein said diaphragm comprises a body made of a foam material, and a sound radiating surface portion connected to said body, said sound radiating surface portion having a film made of a resin, and a heat-fusible adhesive agent placed on one side of said film, said heat-fusible adhesive agent being welded to said body.

14. A speaker as claimed in claim 1, further comprising reinforcing means fixedly connected to said voice coil bobbin and to said diaphragm.

15. A speaker as claimed in claim 14, wherein said reinforcing means comprises a disk having a diameter equal substantially to the inside diameter of said voice coil bobbin, said reinforcing means being located inside said voice coil bobbin.

16. A speaker as claimed in claim 14, wherein said reinforcing means comprises an annular disk having an inside diameter substantially equal to the outside diameter of said voice coil bobbin, said reinforcing means being located outside said voice coil bobbin.

17. A speaker as claimed in claim 14, wherein said reinforcing means comprises a first annular disk having an outside diameter substantially equal to the inside diameter of said voice coil bobbin, and a second annular disk having an inside diameter substantially equal to the outside diameter of said voice coil bobbin, said first and second annular disks being respectively located inside and outside said voice coil bobbin.

18. A speaker as claimed in claim 14, wherein said diaphragm is made of a foam resin.

19. A speaker as claimed in claim 14, wherein said diaphragm comprises a flat disk having a honeycomb mesh structure and a pair of sheets of a light metal attached to the both sides of said disk.

20. A speaker as claimed in claim 14, wherein said reinforcing means is made of a foam resin.

21. A speaker comprising:

(a) a frame structure;

(b) a magnetic circuit means for constituting a magnetic gap, said magnetic circuit means being fixedly connected to said frame structure;

(c) a voice coil bobbin around which a voice coil is wound, said voice coil bobbin being reciprocally movable in said magnetic gap;

(d) a damper connected between said voice coil bobbin and said frame structure;

(e) a diaphragm fixedly connected at one side thereof to one end of said voice coil bobbin, said diaphragm being received in said frame structure without coming into contact with said frame structure;

(f) a diaphragm supporting member made of a viscous material, said diaphragm supporting member being placed between the peripheral surface of said diaphragm and the inner surface of said frame structure; and (g) reinforcing means fixedly connected to said voice coil bobbin and to said diaphragm, said reinforcing means having an annular disk having an inside diameter substantially equal to the outside diameter of said voice coil bobbin, said reinforcing means being located outside said voice coil bobbin.

22. A speaker comprising:

(a) a frame structure;

(b) a magnetic circuit means for constituting a magnetic gap, said magnetic circuit means being fixedly connected to said frame structure;

(c) a voice coil bobbin around which a voice coil is wound, said voice coil bobbin being reciprocally movable in said magnetic gap;

(d) a damper connected between said voice coil bobbin and said frame structure;

(e) a diaphragm fixedly connected at one side thereof to one end of said voice coil bobbin, said diaphragm being received in said frame structure without coming into contact with said frame structure;

(f) a diaphragm supporting member made of a viscous material, said diaphragm supporting member being placed between the peripheral surface of said diaphragm and the inner surface of said frame structure; and (g) reinforcing means fixedly connected to said voice coil bobbin and to said diaphragm, said reinforcing means having a first annular disk having an outside diameter substantially equal to the inside diameter of said voice coil bobbin, and a second annular disk having an inside diameter substantially equal to the outside diameter of said voice coil bobbin, said first and second annular disks being respectively located inside and outside said voice coil bobbin.

* * * * *